US008323072B1

(12) United States Patent
Billig et al.

(10) Patent No.: US 8,323,072 B1
(45) Date of Patent: Dec. 4, 2012

(54) METHOD OF POLISHING TRANSPARENT ARMOR

(75) Inventors: Daniel A. Billig, Maplewood, MN (US); John L. Barry, Stacy, MN (US); James L. McArdle, Stillwater, MN (US); Ann M. Hawkins, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1280 days.

(21) Appl. No.: 12/053,353

(22) Filed: Mar. 21, 2008

Related U.S. Application Data

(60) Provisional application No. 60/896,016, filed on Mar. 21, 2007.

(51) Int. Cl.
*B24B 1/00* (2006.01)

(52) U.S. Cl. ..... 451/41; 451/57; 451/58

(58) Field of Classification Search ..... 451/57, 451/58, 527, 539, 533, 41
See application file for complete search history.

(56) References Cited

U.S. PATENT DOCUMENTS

| | | | | |
|---|---|---|---|---|
| 4,311,489 | A | 1/1982 | Kressner | |
| 4,599,827 | A * | 7/1986 | Goodwin | 451/57 |
| 4,652,274 | A | 3/1987 | Boettcher et al. | |
| 4,652,275 | A | 3/1987 | Bloecher et al. | |
| H244 | H * | 4/1987 | Goodwin | 451/57 |
| 4,735,632 | A | 4/1988 | Oxman et al. | |
| 4,751,138 | A | 6/1988 | Tumey et al. | |
| 4,773,920 | A | 9/1988 | Chasman et al. | |
| 4,799,939 | A | 1/1989 | Bloecher et al. | |
| 4,903,440 | A | 2/1990 | Larson et al. | |
| 4,983,555 | A * | 1/1991 | Roy et al. | 501/120 |
| 5,152,917 | A | 10/1992 | Pieper et al. | |
| 5,236,472 | A | 8/1993 | Kirk et al. | |
| 5,256,170 | A | 10/1993 | Harmer et al. | |
| 5,304,223 | A | 4/1994 | Pieper et al. | |
| 5,368,619 | A | 11/1994 | Culler | |
| 5,435,816 | A | 7/1995 | Spurgeon et al. | |
| 5,437,754 | A | 8/1995 | Calhoun | |
| 5,454,844 | A | 10/1995 | Hibbard et al. | |
| 5,549,962 | A | 8/1996 | Holmes et al. | |
| 5,580,647 | A | 12/1996 | Larson et al. | |
| 5,743,789 | A * | 4/1998 | Russell | 451/57 |
| 5,876,268 | A * | 3/1999 | Lamphere et al. | 451/41 |
| 5,888,119 | A * | 3/1999 | Christianson et al. | 451/41 |
| 5,975,988 | A | 11/1999 | Christianson | |
| 6,217,413 | B1 | 4/2001 | Christianson | |
| 6,227,949 | B1 * | 5/2001 | Yi et al. | 451/57 |

(Continued)

FOREIGN PATENT DOCUMENTS

| | | |
|---|---|---|
| WO | WO 97/11484 | 3/1997 |

OTHER PUBLICATIONS

Product Literature, "3M Electronic Lapping with Trizact™ Diamond Tile" © 2003,2 pages.

(Continued)

*Primary Examiner* — George Nguyen
(74) *Attorney, Agent, or Firm* — Scott A. Baum

(57) ABSTRACT

A method of polishing transparent armor, preferably to optical clarity. The method can be used on flat or contoured armor, manually or via robotic automation. The method includes using a step-wise progression of diamond, structured abrasive articles.

7 Claims, 1 Drawing Sheet

U.S. PATENT DOCUMENTS

| | | | | |
|---|---|---|---|---|
| 6,289,781 | B1 * | 9/2001 | Cohen | 89/36.02 |
| 6,376,009 | B1 * | 4/2002 | Bergvall | 427/162 |
| 6,521,004 | B1 | 2/2003 | Culler et al. | |
| 6,530,826 | B2 * | 3/2003 | Wenski et al. | 451/41 |
| 6,551,366 | B1 | 4/2003 | D'Souza et al. | |
| 6,620,214 | B2 | 9/2003 | McArdle et al. | |
| 6,634,929 | B1 * | 10/2003 | Visser | 451/41 |
| 6,645,624 | B2 | 11/2003 | Adefris et al. | |
| 6,726,535 | B2 * | 4/2004 | Shih et al. | 451/37 |
| 6,749,487 | B2 * | 6/2004 | Okuhata et al. | 451/41 |
| 6,929,539 | B2 * | 8/2005 | Schutz et al. | 451/534 |
| 6,957,511 | B1 * | 10/2005 | Leigh et al. | 451/36 |
| 7,044,835 | B2 | 5/2006 | Mujumdar et al. | |
| 7,077,728 | B1 * | 7/2006 | Achuthan et al. | 451/41 |
| 7,169,031 | B1 | 1/2007 | Fletcher et al. | |
| 7,252,577 | B2 * | 8/2007 | Wood | 451/41 |
| 7,300,479 | B2 | 11/2007 | McArdle et al. | |
| 7,344,574 | B2 | 3/2008 | Thurber et al. | |
| 7,449,413 | B1 * | 11/2008 | Achuthan et al. | 438/692 |
| 7,507,146 | B2 * | 3/2009 | Kato et al. | 451/41 |
| 7,551,981 | B2 * | 6/2009 | Salamanca | 700/259 |
| 7,594,845 | B2 * | 9/2009 | Lugg et al. | 451/41 |
| 7,617,757 | B2 * | 11/2009 | Dickson | 89/36.02 |
| 8,029,335 | B2 * | 10/2011 | Takahashi et al. | 451/11 |
| 8,070,559 | B1 * | 12/2011 | Li et al. | 451/57 |
| 2001/0055941 | A1 * | 12/2001 | Koos et al. | 451/57 |
| 2003/0045212 | A1 * | 3/2003 | Lee et al. | 451/56 |
| 2003/0083000 | A1 * | 5/2003 | Sambuco et al. | 451/49 |
| 2003/0129929 | A1 * | 7/2003 | Monaka et al. | 451/55 |
| 2007/0026770 | A1 | 2/2007 | Fletcher et al. | |
| 2008/0153396 | A1 * | 6/2008 | Laconto et al. | 451/41 |
| 2008/0271595 | A1 * | 11/2008 | Bird et al. | 89/36.02 |
| 2009/0311863 | A1 * | 12/2009 | Hashii et al. | 438/691 |

OTHER PUBLICATIONS

Product Literature, "3M Trizact™ Diamond Tile 677XA" © 2003, 2 pages.

T.D. Fletcher, B. Dronen, F.T. Gobena & E. Larson, "Fixed Abrasive Flat Lapping with 3M™ Trizact™ Diamond Tile Abrasive Pads", Presented at Optifab 2003, Rochester, New York, May 2003, 4 pages.

Jacqueline I. Kroschwitz, High Performance Polymers and Composites, pp. 258-318, 1991.

* cited by examiner

METHOD OF POLISHING TRANSPARENT ARMOR

CROSS REFERENCE TO RELATED APPLICATION

This application claims the benefit of U.S. Provisional Patent Application No. 60/896,016, filed Mar. 21, 2007, the disclosure of which is incorporated by reference herein in its entirety.

TECHNICAL FIELD

This disclosure relates to a method for polishing a transparent armor, to an optically clear finish, using abrasive articles. The transparent armor may be flat or curved.

BACKGROUND

In recent years there has been a tremendous amount of interest in transparent armor for both military and civilian protection. It is desired that the transparent armor is abrasion resistant, relatively low cost, and relatively low weight, and in many applications, it is desired that the transparent armor is optically clear. Likewise since there are countless types of threats (bullets, improvised explosive devices (IEDs), etc.), transparent armor preferably should be effective against multiple types of projectiles and preferably against multiple strikes.

In many instances, transparent armor constructions consist of a hard ceramic layer, which may be bonded to a polymeric layer. The hard ceramic layer is abrasion resistant and resists scratches during normal use. When a projectile encounters the transparent armor, the hard ceramic layer deforms the projectile and resists penetration by the projectile while the polymeric layer supports the ceramic layer and further absorbs energy from the projectile. The combination of the hard ceramic and polymeric layers causes disintegration of the projectile and inhibits the penetration of the projectile through and possibly cause injury. The selection of the particular ceramic layer, and polymeric layer, depends upon the desired end properties of the transparent armor.

One particular transparent armor material is a polycrystalline magnesium-aluminate spinel ceramic (e.g., $MgAl_2O_4$). This material is typically hot-pressed to form the shape, and to produce a dense, pore-free ceramic body. Due to contact with the hot-press platen surfaces, the resulting outer surfaces of the ceramic have a textured, orange-peel-type surface. Even if the hot-pressed ceramic body is dense and pore-free, the rough outer surfaces cause scattering of incident light and thereby result in a non-transparent product. In order to obtain a transparent product, both surfaces must be polished smooth.

However, it is time consuming and difficult to polish the hot-pressed material to optical clarity. The polishing cost may contribute significantly to the overall transparent armor cost and thus inhibit their use.

What is desired is a cost effective means to polish a transparent armor material to achieve optical clarity.

SUMMARY OF THE DISCLOSURE

Briefly, the present disclosure provides a method of polishing transparent armor to optical clarity. The method can be used on flat or contoured armor, manually or via robotic automation using a powered rotary tool. The method includes using a step-wise progression of diamond, structured abrasive articles.

In one aspect of the disclosure, the method comprises providing a transparent armor material that is not optically clear and has a first surface finish, providing a first structured abrasive article comprising a backing and a plurality of shaped composites comprising diamonds therein, securing the first abrasive article to a rotary grinder to form an abrasive tool, and moving the first abrasive article relative to the transparent armor such that the first abrasive article modifies the armor to provide a second surface finish. The second surface finish is closer to optically clear than the first surface finish.

In some embodiments, the rotary grinder is connected to a robot, so that the robot moves the first abrasive article relative to the transparent armor.

In another aspect of the disclosure, the method further comprises providing a second structured abrasive article comprising a backing and a plurality of shaped composites comprising diamonds therein, the diamonds having a smaller particle size than the diamonds of the first abrasive article, securing the second abrasive article to a rotary grinder to form an abrasive tool, and moving the second abrasive article relative to the transparent armor such that the second abrasive article modifies the armor to provide a third surface finish that is closer to optically clear than the second surface finish.

In yet another aspect of this disclosure, a third structured abrasive article, having diamonds with a smaller particle size than the diamonds of the second abrasive article, is used in the same manner subsequent to the second abrasive article to provide a fourth surface finish that is closer to optically clear than the third surface finish.

Any or all of the abrasive articles may be used to abrade the surface of the transparent armor manually or by a robot. As provided above, the transparent armor may be flat or curved.

In another aspect or the disclosure the method comprises finishing transparent ceramic armor selected form the group consisting of spinel, sapphire, and aluminum oxynitride, the method comprising the steps of: providing an abrasive article comprising a structured abrasive layer having a plurality of abrasive composites; the plurality of abrasive composites comprising a matrix binder and a plurality of diamond abrasive particles, the plurality of diamond abrasive particles comprising from about 4 weight percent to about 30 weight percent of the structured abrasive layer; the structured abrasive layer adhered to a first side of a backing, the backing including a second side attached to a first side of a reinforcing layer with an adhesive layer, and; contacting the transparent ceramic armor with the structured abrasive layer, and imparting relative motion between the abrasive article and the transparent ceramic armor.

Other features and advantages of the disclosure will be apparent from the following detailed description of the invention and the claims. The above summary is not intended to describe each illustrated embodiment or every implementation of the present disclosure. The figures and the detailed description that follow more particularly exemplify certain preferred embodiments utilizing the principles disclosed herein.

DETAILED DESCRIPTION OF THE PRESENTLY PREFERRED EMBODIMENTS

Figure 1:
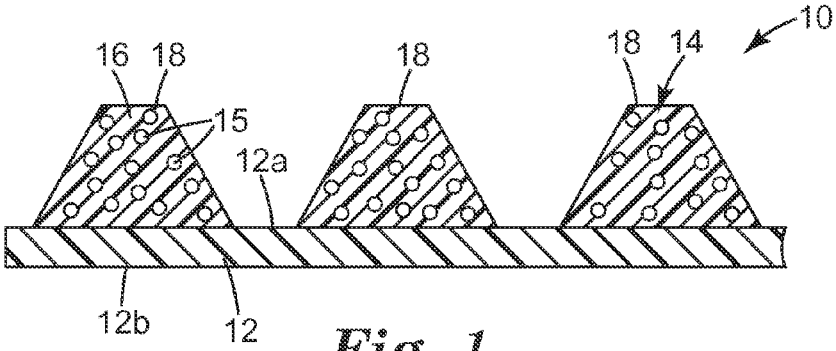
FIG. 1 is a schematic cross-sectional side view of a first embodiment of a structured abrasive article suitable for use with the method of the present invention.

The present invention provides a method of polishing transparent armor to optical clarity. The method can be used on flat or contoured armor, the polishing being done manually, via robotic automation, or using a flat lapping machine such as a Strasbaugh 6DC. As used herein, "flat" means at least essentially planar. The method includes using a step-wise progression of diamond, structured abrasive articles. Alternatively, the method can include a rough grinding step using, for example, a Blanchard grinding machine, an intermediate pre-polish grind and finishing step using one or more structured abrasive articles in a step-wise progression, and a final polish using a polishing abrasive slurry.

As used herein, the term "optically clear", when referring to an item, means that a human can readily see through the item, without significant distortion of the visible images. The term "optical clarity" means that a human can see clearly, without significant distortion or indistinctness or ambiguity. An item that is optically clear or that has optical clarity is generally transparent to the human eye. For many embodiments, an item that is optically clear has an Ra (surface finish) approaching zero, with little or no subsurface occlusions or fissures. In some embodiments, an optically clear item has >85% transmission in the visible and near-infrared wavelength range.

The Ra of a surface is the measurement of the arithmetic average of the scratch depth. It is the average of 5 individual roughness depths of five successive measuring lengths, where an individual roughness depth is the vertical distance between the highest point and a center line. Rz is the average of 5 individual roughness depths of a measuring length, where an individual roughness depth is the vertical distance between the highest point and the lowest point. Rmax is the maximum roughness depth from the highest point and the lowest point in the measuring length.

The surface finish is usually measured with a profilometer which comprises a probe having a diamond tipped stylus. Examples of such profilometers include Surtronic, Surfcom, and Perthometer. Ra, Rz, and Rmax are usually recorded in micrometers or microinches. Extremely fine or smooth surface finishes, too smooth for a profilometer to measure, can be measured with a passive measurement device, such as a WYKO interferometer, and are usually recorded in nanometers or angstroms. In various embodiments of the invention, the Ra of the polished transparent armor can be between about 0.0 to about 1.0 μin, or between about 0.0 to about 0.2 μin.

Transparent Armor

The transparent armor is a polycrystalline ceramic, such as a magnesium-aluminate spinel ($MgAl_2O_4$). The armor generally has a hardness of at least 10 GPa. Spinel and other armor materials, such as aluminum oxynitride ($Al_{23}O_{27}N_5$) and sapphire ($Al_2O_3$), are used as transparent armor by those of skill in the art.

The transparent armor has a first outer surface and a second outer surface. In accordance with the typical manufacturing process to form the pieces (e.g., sheets or plates) of some transparent armor, the material is hot pressed to form the desired overall shape and to produce a fully dense, pore-free ceramic body. The shape can be flat or curved. The transparent armor may range in size of 1 cm by 1 cm to greater than 50 cm by 50 cm and may range in thickness from 0.05 to 1000 mm thick, typically 0.1 to 100 mm thick, although often the thickness is about 10 mm.

After hot pressing the material, the outer surfaces have a textured, orange-peel-type surface, which has a cloudy appearance. Even if the ceramic body is dense and pore-free, the surface texture causes incident light to scatter and thereby provides a non-transparent or translucent product. The present disclosure provides a method to obtain optical clarity of the dense, pore-free ceramic armor piece.

This disclosure provides a method to polish at least one surface of the transparent armor to optical clarity; however typically, polishing is done on both surfaces of the transparent armor. During polishing, the intent is not to distort the shape imparted by molding or some other process prior to the polishing process. Rather during polishing, the intent is to refine the surface finish of the dense, pore-free armor panel and achieve optical clarity with the least amount of transparent armor material removed.

Armor Constructions

The armor construction is designed for the end application and to be protective against the targeted type of bullet and/or explosive device to which it will most likely be exposed. The armor construction is designed to provide the following properties: 1) light weight, 2) transparent in the visible and near-IR wavelengths, 3) optically free of distortion and 4) maximizing ballistic protection. At the same time, this protective armor during use must be 1) abrasion resistant (no scratches to inhibit optical clarity) 2) shock resistant and 3) able to adjust to changing weather conditions including both temperature and moisture content. The temperature can range from −50 F to 150 F, typically −30 F to 140 F. The moisture content can range from low humidity to high humidity. The moisture content also includes rain, snow, sleet, hail, drizzle and the like.

The transparent armor may be incorporated into various constructions to produce protective armor. One common construction comprises the transparent armor layer facing the incident ballistic threat, an adhesive layer, and a force-dissipating backup layer. The transparent armor layer provides abrasion resistance, strength, rigidity, and penetration resistance. The increase in hardness and stiffness is preferred because it causes disintegration of the ballistic threat and resists penetration of the projectile through the armor. The force-dissipating backup layer can flex and absorb the remaining energy of the projectile or remnant fragments of the projectile. The force-dissipating layer should have good shock resistance, good impact resistance and high toughness.

Examples of common laminating adhesives include polyurethane adhesives, polyvinyl buteral, thermosetting resins, UV curable resins, acrylic adhesives and the like.

The force-dissipating layer may comprise: polycarbonate, polyacrylic (including cast acrylic, polymethylmethacrylate, modified acrylics and the like), cellulose acetate butyrate, ionomers, nylons, polyolefins, polyesters, polyurethane (thermosetting and thermoplastic), combinations thereof and the like. Polycarbonate and polyacrylic are the preferred materials for the dissipating layer. The force-dissipating layer may also contain a protective hard coating on the surface opposite the laminating adhesive. This force-dissipating layer may range in thickness from 0.1 to 100 mm thick, typically 0.5 to 50 mm thick. Likewise the force-dissipating layer may be comprised of several thinner layers of the same or different materials laminated together to form the thicker layer.

One common construction comprises the transparent armor, an adhesive layer, a polyurethane interlayer and an energy-absorbing layer. This polyurethane interlayer provides further protection in absorbing the energy from the ballistic, and reducing the transmission of energy from one layer to the next. In another common construction, a silicate glass layer is included between the transparent armor layer and the energy-absorbing layer.

Armor Applications

The transparent armor may be incorporated into a wide range of applications including vehicles (e.g., cars, jeeps, trucks (light and heavy duty)), airplanes, helicopters, tanks, trains, ships, amphibious vehicles; windows (e.g., side, windshields, back); stationary objects (e.g., building windows, doors, bus stops, bullet proof shelters); bulletproof protective clothing (e.g., eye glasses, goggles, face shields). The transparent armor may be incorporated into military, police protection, security services and private applications. The projectiles may be from bullets fired from a weapon including (e.g., hand guns, machine guns, automatic weapons, rifles, assault rifles) or explosive device (e.g., pipe bomb, hand grenade, explosive materials worn by a suicide bomber, car bombs, and the like).

Abrasive Article

In FIG. 1, an abrasive article is illustrated as abrasive article 10. Abrasive article 10 is commonly referred to as a "shaped abrasive article", having a plurality of abrasive particles bonded to a backing. The abrasive article 10 has a backing 12, having a first side 12*a* and an opposite second side 12*b*. An abrasive coating 14 is present on the first side 12*a* of backing 12.

Abrasive coating 14 comprises a plurality of abrasive composites 18, which are composites of abrasive particles 15 distributed in an adhesive matrix 16. Abrasive composites 18 are separated by a boundary or boundaries associated with the composite shape, resulting in one abrasive composite 18 being separated to some degree from another adjacent abrasive composite 18 with a section of the backing 12 visible between abrasive composites. One of the earliest references to structured abrasive articles with precisely shaped abrasive composites is U.S. Pat. No. 5,152,917 to Pieper et al. Many others have followed.

Figure 2:
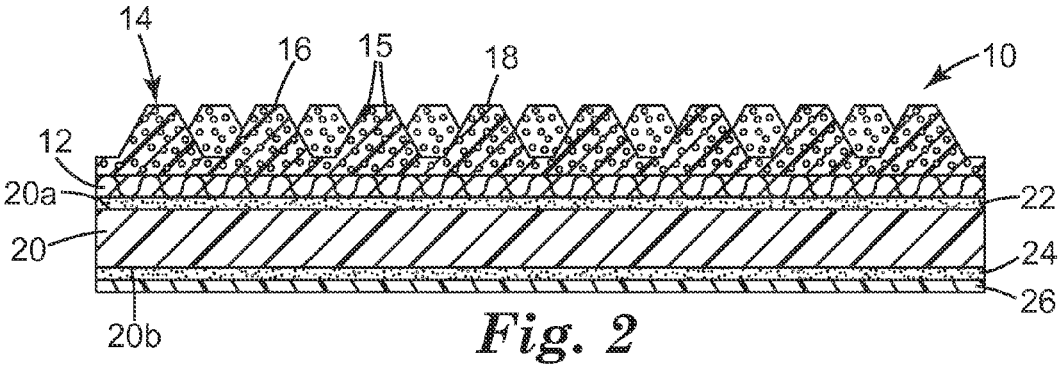
FIG. 2 is a schematic cross-sectional side view of a second embodiment of a structured abrasive article for use with the method of the present invention.

Referring to FIG. 2, an alternative embodiment of the abrasive article 10 is shown. Abrasive article 10 includes a plurality of shaped abrasive composites 18 attached to a backing 12 forming a structured abrasive article. The backing 12 has a substantially continuous layer of abrasive particles 15 dispersed in a binder matrix 16 forming the plurality of shaped abrasive composites 18 such that the backing 12 is no longer visible in the valleys between adjacent shaped abrasive composites 18. The structured abrasive article is attached to a reinforcing layer 20 on a first side 20*a* of the reinforcing layer 20 by an adhesive layer 22. In some embodiments, an attachment adhesive layer 24 is present on a second side 20*b* of the reinforcing layer 20. A release liner 26 may be provided that can be removed to attach the abrasive article 10 to a platen of a grinding or polishing machine. Instead of an adhesive interface layer 24 to attach the abrasive article to a grinding tool, other attachment systems such as hook and loop fasteners, or mechanical fasteners can be used.

Figure 3:
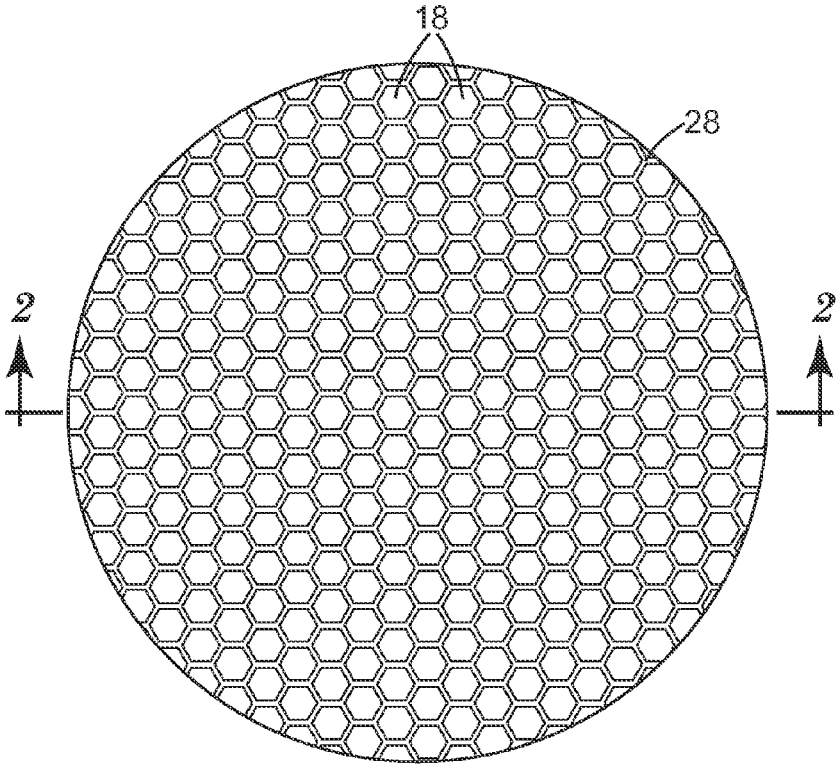
FIG. 3 is a top-view of the structured abrasive article of FIG. 2.

Referring now to FIG. 3, a top-view of the abrasive article of FIG. 2 is shown. The abrasive article 10 can be in the form of an abrasive disk as shown or other common converted form such as an endless belt. The plurality of shaped abrasive composites 18, each comprises a hexagon, in top-view, separated from adjacent shaped abrasive composites by a network valley region 28. The network valley region 28 allows for grinding lubricant to be readily transported to each of the shaped abrasive composites and for grinding residue (swarf) to be transported away from the working surfaces of the shaped abrasive composites.

Alternative abrasive composite shapes include, without limitation, circular, diamond, triangular, rectangular, and square. In one embodiment, the top of each shaped abrasive composite is planar such that the shaped abrasive composite does not come to a peak or a tip; however, pyramidal or conical shaped abrasive composites can be used in some applications.

The spacing of the shaped abrasive composites may vary from about 0.3 shaped abrasive composites per linear cm to about 100 shaped abrasive composites per linear cm, or about 0.4 to about 20 shaped abrasive composites per linear cm, or about 0.5 to 10 shaped abrasive composites per linear cm, or about 0.6 to 3.0 shaped abrasive composites per linear cm. In one aspect of the abrasive article, there are at least about 2 shaped abrasive composites/$cm^2$ or at least about 5 shaped abrasive composites/$cm^2$. In a further embodiment of the invention, the area spacing of shaped abrasive composites ranges from about 1 to about 200 shaped abrasive composites/$cm^2$, or from about 2 to about 10 shaped abrasive composites/$cm^2$.

The height of the abrasive composites as measured from the top of the valley between adjacent shaped abrasive composites to the top of the shaped abrasive composite is constant across the abrasive article 10, but it is possible to have shaped abrasive composites of varying heights. The height of the shaped abrasive composites may be a value from about 10 micrometers to about 25,000 micrometers (2.5 cm), or about 25 to about 15,000 micrometers, or from about 100 to about 10,000 micrometers, or from about 500 to about 4,000 micrometers.

In various embodiments, the bearing area ratio can be between about 20 percent to about 80 percent, or between about 40 percent to about 70 percent, or between about 50 percent to about 70 percent. The bearing area ratio, expressed as a percentage, is the ratio of the total area of the shaped abrasive composites 18 to the total area of the abrasive article including the area of the network valley region 28. Depending on the application or the workpiece, a larger or smaller bearing area ratio may desirable depending on the grade of abrasive, the work piece material, the unit loading pressure, and the desired cut rate and finish.

Backing

Backing 12 includes those known useful in abrasive articles, such as polymeric film, cloth including treated cloth, paper, foam, nonwoven, treated or primed versions thereof, and combinations thereof. Examples include polyester films, polyolefin films (e.g., polyethylene and propylene film), polyamide films, polyimide films and the like. A thin backing can be reinforced using another layer for support, such as a thicker film, or a polycarbonate sheet, for example. In addition, the abrasive article can be attached to a base or sheet or directly to a polishing apparatus or machine via any known route, for example, adhesives including pressure sensitive adhesives are useful.

Backing 12 serves the function of providing a support for the shaped abrasive composites. The backing should be capable of adhering to the binder matrix after exposure of binder precursor to curing conditions, and be strong and durable so that the resulting abrasive article is long lasting. Further, the backing should be sufficiently flexible so that the articles used in the inventive method may conform to surface contours, radii, and irregularities in the workpiece.

As mentioned, the backing may be a polymeric film, paper, vulcanized fiber, a molded or cast elastomer, a treated nonwoven backing, or a treated cloth. Examples of polymeric film include polyester film, co-polyester film, polyimide film, polyamide film, and the like. A nonwoven, including paper, may be saturated with either a thermosetting or thermoplastic material to provide the necessary properties. Any of the above backing materials may further include additives such as: fillers, fibers, dyes, pigments, wetting agents, coupling agents, plasticizers, and the like. In one embodiment, the backing is about 0.05 mm to about 5 mm thick.

Reinforcement Layer

The reinforcement layer 20 can be used to impart additional stiffness, resiliency, shape stability, and/or flatness to the abrasive article 10. The reinforcement layer can be used to stabilize the abrasive article during shape converting processes such as laser or water jet cutting. Desirably, the reinforcement layer comprises plastic such as polycarbonate or acrylic, metal, glass, composite films, or ceramic. In one embodiment, the reinforcement layer 20 is substantially uniform in thickness. Often, the reinforcement layer is desirable to reduce or eliminate deformations in the abrasive article 10 due to grinding platens having scratches or gouges that could deform an abrasive article having only a backing layer.

Abrasive Particles

Abrasive particles 15 are diamonds, either natural diamonds or man-made diamonds and may comprise other abrasive particles by themselves or in combination with the diamonds. The abrasive particles may be present as individual abrasive particles, agglomerates of a single type of abrasive particle or agglomerates of a combination of abrasive particles, or combinations thereof. The diamonds may include a surface coating (e.g., nickel or other metal) to improve the retention of the diamonds in the resin matrix.

The abrasive particles can have an average particle size of about 0.01 micrometer (small particles) to about 1000 micrometers (large particles), or about 0.25 micrometers to about 500 micrometers, or about 3 micrometers to about 400 micrometers, or about 5 micrometers to about 100 micrometers. Occasionally, abrasive particle sizes are reported as "mesh" or "grade", both of which are commonly known abrasive particle sizing methods.

In one embodiment, the abrasive particles have a Mohs hardness of at least 8, or at least 9. Examples of such abrasive particles include fused aluminum oxide, ceramic aluminum oxide, heated treated aluminum oxide, silicon carbide, diamond (natural and synthetic), cubic boron nitride, and combinations thereof. Softer abrasive particles, such as garnet, iron oxide, alumina zirconia, mullite, and ceria, can also be used. The abrasive particles may further comprise a surface treatment or coating, such as a coupling agent or metal or ceramic coatings.

Abrasive particle 15 may be agglomerates of individual abrasive particles. Agglomerates typically comprise a plurality of abrasive particles, a binder, and optional additives. The binder may be organic and/or inorganic. The matrix material can be a resin, a glass, a metal, a glass-ceramic, or a ceramic. For example, glass, such as silica glass, glass-ceramics, borosilicate glass, phenolic, epoxy, acrylic, and the other resins described in the context of the composite binder can be used. Abrasive agglomerates may be randomly shaped or have a predetermined shape associated with them. Additional details regarding various abrasive agglomerate particles and methods of making them may be found, for example, in U.S. Pat. Nos. 4,311,489 (Kressner), 4,652,275 (Bloecher et al.), 4,799,939 (Bloecher et al.), 5,549,962 (Holmes et al.), 5,975,988 (Christianson), 6,620,214 (McArdle), 6,521,004 (Culler et al.), 6,551,366 (D'Souza et al.), 6,645,624 (Adefris et al.). 7,169,031 (Fletcher et al.) and in U.S. application 2007/0026770 (Fletcher et al.).

Generally, the average size of the agglomerate particle, which comprises individual abrasive particles such as diamond particles, ranges from about 1 micrometer to about 1000 micrometers. Often, if the individual abrasive particles within the agglomerates are about 15 micrometers or greater, the overall agglomerate is typically about 100 to about 1000 micrometers, or about 100 to about 400 micrometers, or about 210 to about 360 micrometers. However, when the individual abrasive particles have an average size of about 15 micrometers or less, the overall agglomerate is often about 20 to about 450 micrometers, or about 40 to about 400 micrometers, or about 70 to about 300 micrometers.

The abrasive particles used in the agglomerates can be any known abrasive particle, such as those listed above. Further, a mixture of two or more types of abrasive particles maybe used in the agglomerates. The mixtures of abrasive particles may be present in equal ratios, may have significantly more of a first type of abrasive particle that another type, or have any combination of the different abrasive particles. Mixed abrasive particles may or may not have the same average particle size or the same particle size distribution.

For transparent armor grinding, it is preferred that the abrasive article use diamond abrasive particles or abrasive agglomerates that include diamonds. These diamond abrasive particles may be natural or synthetically made diamond and may be considered "resin bond diamonds", "saw blade grade diamonds", or "metal bond diamonds". The single diamonds may have a blocky shape associated with them, or alternatively, a needle like shape. The single diamond particles may contain a surface coating such as a metal coating (for example, nickel, aluminum, copper or the like), an inorganic coating (for example, silica), or an organic coating. The abrasive article of the invention may contain a blend of diamond with other abrasive particles The preferred amount of abrasive particles in the structured abrasive coating is dependent on the overall abrasive article construction and the process in which it is used. For example, when the abrasive construction is used in a transparent armor polishing application, a particularly useful range of diamond abrasive particles is about 4 weight percent to about 30 weight percent, or about 6 weight percent to about 30 weight percent, or about 20 weight percent to about 30 weight percent.

Abrasive article 10 may include optionally diluent particles, which are not abrasive particles. The particle size of these diluent particles may be on the same order of magnitude as the abrasive particles. Examples of such diluent particles include gypsum, marble, limestone, flint, silica, glass bubbles, glass beads, aluminum silicate, and the like.

Binder Matrix

Abrasive particles 15 are adhered with binder matrix 16 to form composites 18 of the abrasive article 10. Binder matrix 16 is an organic or polymeric binder, and is derived from a binder precursor. During the manufacture of abrasive article 10, the binder precursor is exposed to an energy source which aids in the initiation of the polymerization or curing of the binder precursor. Examples of energy sources include thermal energy and radiation energy, the latter including electron beam, ultraviolet light, and visible light. During this polymerization process, the binder precursor is polymerized or cured and is converted into a solidified binder. Upon solidification of the binder precursor, the adhesive matrix is formed.

Binder matrix 16 can be formed of a curable (via energy such as UV light or heat) organic material. Examples include amino resins, alkylated urea-formaldehyde resins, melamineformaldehyde resins, and alkylated benzoguanamine-formaldehyde resin, acrylate resins (including acrylates and methacrylates) such as vinyl acrylates, acrylated epoxies, acrylated urethanes, acrylated polyesters, acrylated acrylics, acrylated polyethers, vinyl ethers, acrylated oils, and acrylated silicones, alkyd resins such as urethane alkyd resins, polyester resins, reactive urethane resins, phenolic resins such as resole and novolac resins, phenolic/latex resins, epoxy resins such as bisphenol epoxy resins, isocyanates, isocyanurates, polysiloxane resins (including alkylalkoxysilane resins), reactive vinyl resins, phenolic resins (resole and novolac), and the like. The resins may be provided as monomers, oligomers, polymers, or combinations thereof.

The binder precursor can be a condensation curable resin, an addition polymerizable resin, a free radical curable resin, and/or combinations and blends of such resins. One binder precursor is a resin or resin mixture that polymerizes via a free radical mechanism. The polymerization process is initiated by exposing the binder precursor, along with an appropriate catalyst, to an energy source such as thermal energy or radiation energy. Examples of radiation energy include electron beam, ultraviolet light, or visible light.

Examples of free radical curable resins include acrylated urethanes, acrylated epoxies, acrylated polyesters, ethylenically unsaturated monomers, aminoplast monomers having pendant unsaturated carbonyl groups, isocyanurate monomers having at least one pendant acrylate group, isocyanate monomers having at least one pendant acrylate group, and mixtures and combinations thereof. The term acrylate encompasses acrylates and methacrylates.

One binder precursor comprises a urethane acrylate oligomer, or a blend of a urethane acrylate oligomer and an ethylenically unsaturated monomer. Useful ethylenically unsaturated monomers are monofunctional acrylate monomers, difunctional acrylate monomers, trifunctional acrylate monomers, or combinations thereof. The binder formed from these binder precursors provides the abrasive article with its desired properties. In particular, these binders provide a tough, durable, and long lasting medium to securely hold the abrasive particles throughout the life of the abrasive article. This binder chemistry is useful when used with diamond abrasive particles because diamond abrasive particles last substantially longer than most conventional abrasive particles. In order to take full advantage of the long life associated with diamond abrasive particles, a tough and durable binder is desired. Thus, this combination of urethane acrylate oligomer or blend of urethane acrylate oligomer with an acrylate monomer and diamond abrasive particles provides an abrasive coating that is long lasting and durable.

Examples of acrylated urethanes include those known by the trade designations "PHOTOMER" (for example, "PHOTOMER 6010"), commercially available from Henkel Corp., Hoboken, N.J.; "EBECRYL 220" (hexafunctional aromatic urethane acrylate of molecular weight 1,000), "EBECRYL 284" (aliphatic urethane diacrylate of 1,200 molecular weight diluted with 1,6-hexanediol diacrylate), "EBECRYL 4827" (aromatic urethane diacrylate of 1,600 molecular weight), "EBECRYL 4830" (aliphatic urethane diacrylate of 1,200 molecular weigh diluted with tetraethylene glycol diacrylate), "EBECR YL 6602" (trifunctional aromatic urethane acrylate of 1,300 molecular weight diluted with trimethylolpropane ethoxy triacrylate), and "EBECRYL 840" (aliphatic urethane diacrylate of 1,000 molecular weight), commercially available from UCB Radcure Inc., Smyrna, Ga.; "SARTOMER" (for example, "SARTOMER 9635, 9645, 9655, 963-B80, 966-A80", etc.), commercially available from Sartomer Company, West Chester, Pa.; and "UVITHANE" (for example, "UVITHANE 782"), commercially available from Morton International, Chicago, Ill.

The ethylenically unsaturated monomers or oligomers, or acrylate monomers or oligomers, may be monofunctional, difunctional, trifunctional or tetrafunctional, or even higher functionality. The term acrylate includes both acrylates and methacrylates. Ethylenically unsaturated binder precursors include both monomeric and polymeric compounds that contain atoms of carbon, hydrogen, and oxygen, and optionally, nitrogen and the halogens. Ethylenically unsaturated monomers or oligomers preferably have a molecular weight of less than about 4,000, and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate. Other ethylenically unsaturated monomers or oligomers include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl)isocyanurate, 1,3,5-tri(2-methacryloxyethyl)-s-triazine, acrylamide, methylacrylamide, N-methyl-acrylamide, N,N-dimethylacrylamide, N-vinylpyrrolidone, and N-vinyl-piperidone, and "CMD 3700", commercially available from Radcure Specialties. Examples of ethylenically unsaturated diluents or monomers may be found in U.S. Pat. Nos. 5,236,472 and 5,580,647.

In general, the ratio between these acrylate monomers depends upon the weight percent of diamond abrasive particles and any optional additives or fillers desired in the final abrasive article. Typically, these acrylate monomers range from about 5 parts by weight to about 95 parts by weight urethane acrylate oligomer to about 5 parts by weight to about 95 parts by weight ethylenically unsaturated monomer. Additional information concerning other potential useful binders and binder precursors is found in PCT WO 97/11484 and U.S. Pat. No. 4,773,920.

Acrylated epoxies are diacrylate esters of epoxy resins, such as the diacrylate esters of bisphenol A epoxy resin. Examples of acrylated epoxies include "CMD 3500", "CMD 3600", and "CMD 3700", all commercially available from Radcure Specialties; and "CN103", "CN104", "CN111", "CN112", and "CN114", all commercially available from Sartomer Company.

Examples of polyester acrylates include "PHOTOMER 5007" and "PHOTOMER 5018", commercially available from Henkel Corporation.

Aminoplast monomers have at least one pendant alpha, beta-unsaturated carbonyl group. These unsaturated carbonyl groups may be acrylate, methacrylate or acrylamide type groups. Examples of such materials include N-(hydroxymethyl)-acrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440 and 5,236,472.

Isocyanurates having at least one pendant acrylate group and isocyanate derivatives having at least one pendant acrylate group are further described in U.S. Pat. No. 4,652,274. The preferred isocyanurate material is a triacrylate of tris (hydroxy ethyl) isocyanurate.

Depending upon how the free radical curable resin is cured or polymerized, the binder precursor may further comprise a curing agent, (which is also known as a catalyst or initiator). When the curing agent is exposed to the appropriate energy source, it will generate a free radical source that will start the polymerization process.

Another preferred binder precursor comprises an epoxy resin. Epoxy resins have an oxirane ring and are polymerized by a ring opening reaction. Such epoxide resins include monomeric epoxy resins and polymeric epoxy reins. Examples of preferred epoxy resins include 2,2-bis-4-(2,3-epoxypropoxy)-phenylpropane, a diglycidyl ether of bisphenol, which include "EPON 828", "EPON 1004", and "EPON 1001F", commercially available from Shell Chemical Co., Houston, Tex., and "DER-331", "DER-332", and "DER-334", commercially available from Dow Chemical Co, Midland, Mich. Other suitable epoxy resins include cycloaliphatic epoxies, glycidyl ethers of phenol formaldehyde novolac (for example, "DEN-431" and "DEN-428"), commercially available from Dow Chemical Co. Examples of usable multi-functional epoxy resins are "MY 500", "MY 510", "MY 720" and "Tactix 742", all commercially available from Ciba Specialty Chemicals, Brewster, N.Y., and "EPON HPT 1076" and "EPON 1031" from Shell. The blend of free radical curable resins and epoxy resins are further described in U.S. Pat. Nos. 4,751,138 and 5,256,170.

In one embodiment, the binder materials, when incorporated with the abrasive particles in the abrasive article, have high thermal resistance. Specifically, the cured binder has a glass transition temperate (i.e., Tg) of at least 150° C., or at least 160° C., or at least 175° C. is desired, or at least 200° C. Large amounts of heat are generated during the grinding process; the abrasive article, in particular the binder, should be able to withstand the grinding temperatures with minimal degradation. High temperature resistance in epoxies is generally understood; see for example, *High Performance Polymers and Composites*, pp. 258-318, ed Jacqueline I. Kroschwitz, 1991. Generally, multi-functional epoxies provide high thermal resistance.

Additives

The abrasive agglomerates, abrasive coating and the backings of this invention can have additives, such as abrasive particle surface modification additives, coupling agents, fillers, expanding agents, fibers, pore formers, antistatic agents, curing agents, suspending agents, photosensitizers, lubricants, wetting agents, surfactants, pigments, dyes, UV stabilizers, and anti-oxidants. The amounts of these materials are selected to provide the properties desired.

A coupling agent may provide an association bridge between the binder and the abrasive particles, and any filler particles. Examples of coupling agents include silanes, titanates, and zircoaluminates. The coupling agent can be added directly to the binder precursor, which may have about 0 to 30%, preferably 0.1 to 25% by weight coupling agent. Alternatively, the coupling agent can be applied to the surface of any particles, typically about 0 to 3% by weight coupling agent, based upon the weight of the particle and the coupling agent. Examples of commercially available coupling agents include "A174" and "A1230", commercially available from OSi Specialties, Danbury, Conn. Still another example of a commercial coupling agent is an isopropyl triisosteroyl titanate, commercially available from Kenrich Petrochemicals, Bayonne, N.J., under the trade designation "KR-TTS".

The abrasive agglomerates or abrasive coating may further optionally comprise filler particles. Fillers generally have an average particle size range of 0.1 to 50 micrometers, typically 1 to 30 micrometers. Examples of useful fillers for this invention include: metal carbonates (such as calcium carbonate-chalk, calcite, marl, travertine, marble, and limestone; calcium magnesium carbonate, sodium carbonate, and magnesium carbonate), silica (such as quartz, glass beads, glass bubbles, and glass fibers), silicates (such as talc, clays-montmorillonite; feldspar, mica, calcium silicate, calcium metasilicate, sodium aluminosilicate, sodium silicate, lithium silicate, and hydrous and anhydrous potassium silicate), metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide-lime; aluminum oxide; tin oxide-for example, stannic oxide; titanium dioxide) and metal sulfites (such as calcium sulfite), thermoplastic particles (such as polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles), and the like. The filler may also be a salt such as a halide salt. Examples of halide salts include sodium chloride, potassium cryolite, sodium cryolite, ammonium chloride, potassium tetrafluoroborate, sodium tetrafluoroborate, silicon fluorides, potassium chloride, and magnesium chloride. Examples of metal fillers include, tin, lead, bismuth, cobalt, antimony, cadmium, iron, and titanium. Other miscellaneous fillers include sulfur, organic sulfur compounds, graphite, and metallic sulfides.

Either of the agglomerates, or abrasive coating, or both may include fillers or other materials that are pore formers. Pores may be desired for constructions where quick agglomerate or coating break-down is desired. Examples of pore formers include organic materials that are sacrificed; for example, organic materials can be used to occupy volume in the agglomerate or abrasive coating, and then are removed, for example, by burning or dissolving. Examples of sacrificial pore formers are styrene balls and dextrin powder. Pores may also be formed by permanent pore formers, such as glass or alumina hollow beads or bubbles, or by foamed inorganic materials.

An example of a suspending agent is an amorphous silica particle having a surface area less than 150 meters square/gram, commercially available from DeGussa Corp., Ridgefield Park, N.J., under the trade designation "OX-50". The addition of the suspending agent may lower the overall viscosity of the abrasive slurry. The use of suspending agents is further described in U.S. Pat. No. 5,368,619.

It may be desirable in some embodiments to form the shaped abrasive composites from an abrasive slurry which has controllable settling of the abrasive particles. As an example, it may be possible to form an abrasive slurry having diamond abrasive particles homogeneously mixed throughout. After casting or molding the composites and backing from the slurry, the diamond particles may settle out at a controlled rate so that by the time the organic resin has hardened to the point where the diamond particles may no longer settle, the diamond particles have departed from the backing and are located only in the composites.

The binder precursor may further comprise a curing agent. A curing agent is a material that helps to initiate and complete the polymerization or crosslinking process such that the binder precursor is converted into a binder. The term curing agent encompasses initiators, photoinitiators, catalysts and activators. The amount and type of the curing agent will depend largely on the chemistry of the binder precursor.

Polymerization of ethylenically unsaturated monomer(s) or oligomer(s) occurs via a free-radical mechanism. If the energy source is an electron beam, or ionizing radiation source (gamma or x-ray), free-radicals which initiate polymerization are generated. However, it is within the scope of this invention to use initiators even if the binder precursor is exposed to an electron beam. If the energy source is heat, ultraviolet light, or visible light, an initiator may have to be present in order to generate free-radicals. Examples of initiators (that is, photoinitiators) that generate free-radicals upon exposure to ultraviolet light or heat include, but are not limited to, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. An example of a commercially available photoinitiator that generates free radicals upon exposure to ultraviolet light include those having the trade designation "IRGACURE 651" and "IRGACURE 184", commercially available from Ciba Geigy Company, Hawthorne, N.J., and "DAROCUR 1173", commercially available from Merck & Company, Incorporated, Rahway, N.J. Examples of initiators that generate free-radicals upon exposure to visible light may be found in U.S. Pat. No. 4,735,632. Another photoinitiator that generates free-radicals upon exposure to visible light has the trade designation "IRGACURE 369", commercially available from Ciba Geigy Company.

Typically, the initiator is used in amounts ranging from 0.1 to 10%, preferably 2 to 4% by weight, based on the weight of the binder precursor. Additionally, it is preferred to disperse, preferably uniformly disperse, the initiator in the binder precursor prior to the addition of any particulate material, such as the abrasive particles and/or filler particles.

In general, it is preferred that the binder precursor be exposed to radiation energy, preferably ultraviolet light or visible light. In some instances, certain abrasive particles and/or certain additives will absorb ultraviolet and visible light, which makes it difficult to properly cure the binder precursor. This phenomena is especially true with ceria abrasive particles and silicon carbide abrasive particles. It has been found, quite unexpectedly, that the use of phosphate containing photoinitiators, in particular acylphosphine oxide containing photoinitiators, tend to overcome this problem. An example of such a photoinitiator is 2,4,6-trimethylbenzoyldiphenylphosphine oxide, commercially available from RASF Corporation, Charlotte, N.C., under the trade designation "LUCIRIN TPO". Other examples of commercially available acylphosphine oxides include those having the trade designation "DAROCUR 4263" and "DAROCUR 4265", both commercially available from Ciba Specialty Chemicals.

Optionally, the curable compositions may contain photosensitizers or photoinitiator systems which affect polymerization either in air or in an inert atmosphere, such as nitrogen. These photosensitizers or photoinitiator systems include compounds having carbonyl groups or tertiary amino groups and mixtures thereof. Among the preferred compounds having carbonyl groups are benzophenone, acetophenone, benzil, benzaldehyde, o-chlorobenzaldehyde, xanthone, thioxanthone, 9,10-anthraquinone, and other aromatic ketones which may act as photosensitizers. Among the preferred tertiary amines are methyldiethanolamine, ethyldiethanolamine, triethanolamine, phenylmethyl-ethanolamine, and dimethylaminoethylbenzoate. In general, the amount of photosensitizer or photoinitiator system may vary from about 0.01 to 10% by weight, more preferably from 0.25 to 4.0% by weight, based on the weight of the binder precursor. Examples of photosensitizers include those having the trade designation "QUANTICURE ITX", "QUANTICURE QTX", "QUANTICURE PTX", "QUANTICURE EPD", all commercially available from Biddle Sawyer Corp., New York, N.Y.

In one embodiment, the binder precursor is cured with the aid of both a photoinitiator and a thermal initiator acting on the same functional type. Examples of initiators include organic peroxides (e.g., benzoil peroxide), azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Examples of suitable commercially available, ultraviolet-activated photoinitiators are sold under the trade designations IRGACURE 651, IRGACURE 184, IRGACURE 369 and IRGACURE 819, all commercially available from the Ciba Geigy Company, Lucirin TPO-L, commercially available from BASF Corp. and DAROCUR 1173 commercially available from Merck & Co. Examples of suitable thermal initiators are sold under the trade designations VAZO 52, VAZO 64 and VAZO 67 azo compound thermal initiators, all commercially available from E.I. duPont deNemours and Co.

Method of Making Abrasive Articles

Abrasive articles 10 can be made via any known method for making an abrasive article having three-dimensional abrasive composites. Useful methods are described in U.S. Pat. Nos. 5,152,917 (Pieper et al.) and 5,435,816 (Spurgeon et al.), and other suitable methods can be found in U.S. Pat. Nos. 5,437,754 (Calhoun), 5,454,844 (Hibbard et al.), and 5,304,223 (Pieper et al.).

Another useful method of making useful abrasive articles having three-dimensional, abrasive composites where the composites comprise abrasive agglomerates fixed in a make coat, with optional size coatings, is described in U.S. Pat. No. 6,217,413 (Christianson).

Method of Polishing

The method of this disclosure provides an optically clear finish on at least one side of transparent armor. Usually, both sides of the armor are processed in order to provide armor through which one can readily see. The method of this disclosure utilizes a series of abrasive articles and a series of abrasive polishing steps. Each abrasive step further refines the surface finish with the goal to achieve optical clarity in a dense, pore-free ceramic body. In some embodiments, optical clarity (from the hot pressed piece) may be obtained in 5 hours of polishing or less. For both sides of the armor piece, optical clarity may be obtained in 10 hours of polishing or less. For some embodiments, optical clarity may be obtained in 3 hours or less of polishing, 6 hours or less for both sides.

The method includes using a step-wise progression of diamond, structured abrasive articles, such as abrasive article 10. The particle size of the diamonds present in abrasive article 10 used decreases as the surface finish of the armor approaches optical clarity.

The method includes affixing the abrasive article to a rotary tool, such as a random orbital sander, and polishing the surface of the armor with the abrasive article. When that grade of abrasive article provides no additional improvement in the surface finish, a next abrasive article, having a smaller diamond particle size, is used to polish the armor. Similarly, when that grade of abrasive article provides no additional improvement in the surface finish, a next abrasive article, having a smaller diamond particle size, is used to polish the armor. Eventually, optically clear transparent armor is obtained. Typically, the decrease in diamond particle size from one abrasive article to the next is about 50%.

As mentioned, the method of this disclosure utilizes a rotary tool onto which the abrasive articles are affixed. Examples of rotary tools include random orbital sanders and rotary sanders. The tool can be pneumatic or electric, however pneumatic is preferred for a random orbital sander and electric is preferred for rotary tools. The rotating hand tools may operate at speed suitable for the operation; 12,000 rpm is one suitable speed. The speed is dependent upon many factors including tool design, back up pad and abrasive article.

Generally a back up pad, to which the abrasive article is secured, is attached to the tool. The back up pad may be constructed from a foam or rubber type material with an appropriate facing. The back up pad outer face will have some form of receiving surface such that the fixed abrasive article can be secured to the back up pad. For example, if a pressure sensitive adhesive is employed to secure the fixed abrasive article to the back up pad, then the receiving surface may be a vinyl facing, cloth facing or rubber facing. Alternatively, if a hook and loop type attachment is employed to secured the fixed abrasive article to the back up pad, then the receiving surface may be either a loop facing or hook facing. The opposite type would then be used on the abrasive article.

The transparent armor may be polished, with the rotary tool having structured diamond abrasive article thereon, either manually or by a robot. When a robot is used, the tool is often connected to a portion of the robot, typically referred to as an "arm", which moves the rotary tool in a manner similar to how a human operator would move the tool. The piece being polished is held stationary. A robot arm has minimum of 3 degrees of freedom although a robot with a minimum of 6 degrees of freedom is preferred, allowing movement and rotation of the tool in numerous axes. In other embodiments, the tool is fixed, while the robot moves the piece (i.e., the transparent armor) with minimum of 3 degrees of freedom although a minimum of 6 degrees of freedom is preferred, in relation to the tool.

The robot uses commercially available 'end of arm tooling' to apply a generally constant contact force between the abrading tool and the surface being polished (i.e., the transparent armor). The robot is programmed to have the tool with abrasive article thereon follow the contour of the transparent armor piece without significantly changing the contour of the piece. In general, the robot does not provide sufficient rigidity and accuracy to change the overall shape of the piece being polished, unlike a CNC machine. In some embodiments, a CNC machine or other deterministic grinding process may be used to decrease the surface finish of the hot pressed piece prior to polishing with the first structured abrasive article.

In another embodiment, the method includes an initial rough grinding step with, for example, a Blanchard grinding machine, an intermediate pre-polish grind and finish step with one or more of the structured abrasive articles of FIGS. 2 and 3 in a step-wise progression attached to a platen of a flat lapping machine such as a Strasbaugh 6DC, and a final polishing step using polishing abrasive slurry. Relative motion between the transparent armor and the structured abrasive article is provided by the lapping machine. After conclusion of the three steps, the polished surface of the ceramic transparent armor will be optically clear and the Ra of the polished transparent armor can be between about 0.0 to about 1.0 μin, or between about 0.0 to about 0.2 μin.

A working fluid is typically present between the interface of the abrasive article and the transparent armor during the polishing steps or during the grinding step or during the pre-polish grind and finish step. Any known working fluid may be used. For example, water, aqueous solutions, and the like may be used, with particular selection known by those with skill of the art. Various additives may be present in the working fluid.

Objects and advantages of this invention are further illustrated by the following examples, but the particular materials and amounts thereof recited in these examples, as well as other conditions and details, should not be construed to unduly limit this invention.

EXAMPLES

The following sequence of steps was used to polish, manually, a 13.25 inch×11.5 inch curved transparent armor spinel panel (i.e., a magnesium-aluminate spinel).

The rotary tool used was a Dynabrade Model 59200 12,000 RPM, ⅜" orbit, Random Orbital sander. A 3M Stikit Low Profile Backup Pad, Part #05555, was attached to the rotary tool. A North/South/East/West tool pattern with subtle variations on each pass was used in an effort to generate even wear across the armor plate.

The following six abrasive articles were progressively used. All of the abrasive articles were five-inch diameter discs with a pressure-sensitive-adhesive (PSA) attachment system. Each abrasive article was used for the time indicated (e.g., 5 minutes, 3 minutes, 6 minutes), after which 3 to 5 surface measurements were taken. When that abrasive article provided no additional improvement in the surface finish, the next abrasive article, having a smaller diamond particle size, was used to polish the armor.

Abrasive article #1: 3M Trizact Industrial Diamond structured abrasive article; having flat-top hexagonal composites about 30 mil high, 200/230 grade (about 70 micrometer) individual diamond particles having a Ni coating, on a cloth backing.

Abrasive article #2: 3M Trizact Industrial Diamond structured abrasive article; having flat-top hexagonal composites about 30 mil high, 325/400 grade (about 40 micrometer) individual diamond particles having a Ni coating, on a cloth backing Abrasive article #3: 3M Trizact Diamond Tile 677×A commercially available structured abrasive article, having flat-top square composites, 9 micrometer diamond particles agglomerated with glass binder, on a film backing Abrasive article #4: 3M Trizact Diamond Tile 677×A commercially available structured abrasive article, having flat-top square composites, 6 micrometer diamond particles agglomerated with glass binder, on a film backing Abrasive article #5: 3M Trizact Diamond Tile 677×A commercially available structured abrasive article, having flat-top square composites, 3 micrometer diamond particles agglomerated with glass binder, on a film backing Abrasive article #6: 3M Trizact structured abrasive article, having pyramidal rectangular composites, 1 micrometer diamond particles, on a film backing.

TABLE 1

| Abrasive Article | Time (min) | Ra (μinch) | Rz (μinch) | Rmax (μinch) | Comments |
|---|---|---|---|---|---|
| #1 | 5 | 26.8 | 212 | | The spinel had been processed with other products prior to this step. Starting with molded spinel would require longer time. |
| | | 24.6 | 175 | | |
| | | 20.3 | 169 | | |

TABLE 1-continued

| Abrasive Article | Time (min) | Ra (μinch) | Rz (μinch) | Rmax (μinch) | Comments |
|---|---|---|---|---|---|
| #2 | 5 | 19.9 | 145 | | |
| | | 17.9 | 125 | | |
| | | 16.6 | 144 | | |
| #2 | 3 | 13.1 | 102 | | |
| | | 15.4 | 131 | | |
| | | 17.7 | 142 | | |
| #3 | 3 | 10.6 | 100 | | |
| (previously | | 14.2 | 123 | | |
| used disc) | | 11.7 | 103 | | |
| | | 12.3 | 114 | | |
| #3 | 3 | 10.9 | 104 | | |
| (new disc) | | 13.5 | 115 | | |
| | | 12.28.2006 | 98 | | |
| | | 13.5 | 126 | | |
| #4 | 3 | 5.67 | 74 | | |
| (previously | | 3.74 | 73 | | |
| used disc) | | 4.16 | 51 | | |
| #4 | 3 | 3.18 | 46 | | |
| (previously | | 2.29 | 41 | | |
| used disc) | | 2.14 | 37 | | |
| #5 | 6 | 3.21 | 55 | | |
| (previously | | 1.76 | 33 | | |
| used disc) | | 1.64 | 31 | | |
| | | 1.26 | 27 | | |
| #5 | 6 | 1.81 | 33 | | |
| (previously | | 1.86 | 37 | | |
| used disc) | | 1.68 | 37 | | |
| | | 2.82 | 39 | | |
| #6 | 6 | 1.58 | 41 | | |
| | | 2.77 | 58 | | |
| | | 1.23 | 23 | | |
| #6 | 6 | 0.74 | 25 | | *Taken at ~2" from |
| | | 1.43 | 36 | | edge, which was a |
| | | 0.46* | 12* | | clearer area. |
| | | 0.98 | 18 | | |
| #6 | 6 | 0.99 | 28 | | |
| | | 1.38 | 31 | | |
| | | 2.01 | 34 | 100 | |
| | | 0.53 | 11 | 17 | |
| | | 0.51 | 16 | 22 | |
| #6 | 6 | 1.13 | 22 | 31 | |
| | | 1.05 | 26 | 39 | |
| | | 0.91 | 19 | 27 | |
| | | 0.77 | 16 | 31 | |
| #6 | 6 | 0.67 | 19 | 24 | |
| | | 1.00 | 21 | 27 | |
| | | 0.32 | 8.4 | 18 | |
| | | 0.59 | 15 | 20 | |
| #6 | 6 | 1.09 | 28 | 42 | |
| | | 1.24 | 24 | 35 | |
| | | 0.83 | 18 | 40 | |
| | | 0.83 | 25 | 63 | |
| #6 | 6 | 0.60 | 17 | 37 | |
| | | 1.55 | 25 | 36 | |
| | | 1.49 | 26 | 36 | |
| | | 1.26 | 28 | 42 | |
| #6 | 6 | 0.73 | 24 | 5542 | |
| | | 1.04 | 23 | 54 | |
| | | 1.01 | 34 | 58 | |
| | | 1.34 | 29 | | |
| #6 | 6 | 0.48 | 8 | 22 | |
| | | 0.93 | 19 | 22 | |
| | | 0.55 | 16 | 29 | |
| | | 0.88 | 20 | 28 | |
| #6 | 6 | 0.39 | 11 | 18 | |
| | | 0.40 | 9.8 | 24 | |
| | | 0.65 | 18 | 28 | |
| | | 1.08 | 21 | 32 | |

The following non-limiting examples will further illustrate the invention. All parts, percentages, ratios, etc., in the examples are by weight unless otherwise indicated. The following abbreviations listed in Table 2 are used throughout the additional examples.

TABLE 2

| | |
|---|---|
| TMPTA | Trimethylol propane triacrylate; commercially available from Sartomer Co. under the trade designation "SR351" |
| PH2 | Photo initiator 2-benzyl-2-N,N-dimethylamino-1-(4-morpholinophenyl)-1-butanone, commercially available from Ciba Geigy Corp. under the trade designation "Irgacure 369" |
| THI | Thermal initiator 2,2'-azobis(2,4-dimethylpentanenitrile), commercially available from Dupont Chemical Solution Enterprise, Bell WV under the trade designation "Vazo 52" |
| CaSi | Surface-modified calcium metasilicate filler, commercially available from NYCO, Willsboro NY under the trade designation "Wollastocoat M400" |
| SCA | Silane coupling agent, 3-methacryloxypropyltrimethoxysilane, commercially available from Crompton Corp. under the trade designation "A-174NT" |
| ASF | Amorphous silica filler, commercially available from DeGussa under the trade designation "OX-50" |
| 120/140 | Mesh-grade diamond abrasive, commercially available from Pinnacle Abrasives, Walnut Creek, CA, under the trade designation "120/140 CMDP/CRDH" |
| 200/230 | Mesh-grade diamond abrasive, commercially available from Pinnacle Abrasives, Walnut Creek, CA, under the trade designation "200/230 CMDP/CRDH" |
| 325/400 | Mesh-grade diamond abrasive, commercially available from Pinnacle Abrasives, Walnut Creek, CA, under the trade designation "325/400 CMDP/CRDH" |
| 9 μm | Micron-grade diamond abrasive, commercially available from Pinnacle Abrasives, Walnut Creek, CA, under the trade designation "8-12 MPP" and formed into vitrified agglomerate abrasive particles using Method 1. |

Method 1: Preparation of Vitreous Bonded Diamond Agglomerate Abrasive Particles

Vitrified agglomerate abrasive particles were produced as taught in U.S. Pat. No. 6,551,366 (D'Souza et al). An agglomerate precursor slurry was prepared as follows. About 31 grams of dextrin (a temporary starch binder obtained under the trade designation "STADEX 230" from A. E. Staley Manufacturing Company, Decatur, Ill.) was dissolved in about 687 grams of deionized water by stirring using an air mixer with a Cowles blade. Next, about 500 grams of milled glass frit (obtained under the trade designation "SP1086" from Specialty Glass, Inc. Wilmington, Del.) was added to the solution. The glass frit had been milled prior to use to a median particle size of about 2.5 micrometers. Next, about 500 grams of 8-12 micrometer diamond powder (available from Pinnacle Abrasives, Walnut Creek Calif., under the trade designation "8-12 MPP") was added to the slurry. The slurry was stirred using the air mixer for an additional 30 minutes after all the above constituents had been added together.

The agglomerate precursor slurry was spray dried using a rotary wheel spray-dryer (obtained under the trade designation "MOBILE MINOR UNIT" from Niro Inc.). The spray dryer inlet temperature was set at about 150° C., and the rotary wheel set at about 15,000 rpm. The slurry was pumped into the rotary wheel inlet at a pump speed flow rate setting of 4. The outlet temperature of the spray dryer varied from 90-95° C. during the spray drying of the slurry. The plurality of precursor agglomerate abrasive grains was collected at the spray dryer outlet.

The spray dried precursor agglomerate grains were mixed with about 30% by weight of 3 micrometer white aluminum oxide (obtained under the trade designation "PWA3" from Fujimi Corporation, Elmhurst, Ill.), based on the weight of the plurality of precursor agglomerate grains, and heated in a furnace in air. The heating schedule was as follows: 2° C./min. increase to 400° C., 1 hour hold at 400° C., 2° C./min. increase to 750° C., 1 hour hold at 750° C., and 2° C./min. decrease to 35° C. After heating, the agglomerate abrasive grains were sieved through a 106 μm mesh screen.

Method 2: Procedure for Making Abrasive Articles

Abrasive slurry was prepared by mixing the abrasive mineral particles, binder precursor and other materials listed in Table 3 below. The abrasive slurry was mixed for about 30 minutes at about 1200 rpm using a high shear mixer until the slurry temperature reached approximately 80° F. (26° C.).

TABLE 3

| Description | | | Binder precursor formulation (g) | | | | | | Abrasive mineral (g) | | | |
|---|---|---|---|---|---|---|---|---|---|---|---|---|
| Ex | Grade | Backing | TMPTA | PH2 | THI | CaSi | SCA | ASF | 120/140 | 200/230 | 325/400 | 9 um |
| 1 | A10 | film | 1437 | 14.1 | 0 | 2210 | 49.8 | 11.6 | | | | 280 |
| 2 | A45 | cloth | 1386 | 12.9 | 12.9 | 1455 | 0 | 27.8 | | | 1106 | |
| 3 | A80 | cloth | 1384 | 12.8 | 12.7 | 1453 | 0 | 33.1 | | 1030 | | |
| 4 | A160 | cloth | 1386 | 12.8 | 12.8 | 1455 | 0 | 27.7 | 1000 | | | |

The backing for the abrasive articles in Examples 2-4 was a Y-weight polyester cloth backing having a backing treatment preparable by at least partially polymerizing an isotropic backing treatment precursor compromising polyepoxide, polyfunctional urethane (meth)acrylate, non-urethane polyfunctional (meth)acrylate, acidic free-radically polymerizable monomer, dicyandiamide, photoinitiator, as taught in U.S. Pat. No. 7,344,574 (Thurber, et al.). The backing for Example 1 was a polyester film 0.005 inches (127 um) thick and having an ethylene acrylic acid co-polymer primer on the surface to be coated. The film backing is commercially available from 3M Company, St. Paul Minn. under the trade designation "5 mil Scotchpak™".

The production tool was transparent polypropylene tooling that had been embossed using a cut knurl nickel-plated master tool. The polypropylene tool had a plurality of cavities defined by a hexagonal-based post type pattern. The length of each hexagon cavity side was about 0.078 inch (1981 um) as measured at the base of the cavity. The hexagonal cavities were placed such that their bases were spaced about 0.055 inch (1397 um) apart, and the sides of the hexagonal cavities were sloped 8 degrees so that the space between the tops of neighboring cavities was about 0.047 inch (1194 um). The depth of the hexagonal cavities was about 0.030 inch (762 um), which corresponds to the resulting height of the shaped abrasive composites.

The abrasive articles of Examples 1-4 were made on an apparatus similar to that illustrated in FIG. 3 in U.S. Pat. No. 7,300,479 (McArdle). The polypropylene production tool was unwound from a winder. The abrasive slurry was knife coated about 10 inches (25.4 cm) wide onto the front side of the backing. The knife gap was set to be approximately 0.026-0.034 inches (660-864 micrometers). The slurry-coated backing was brought into contact with the cavities of the production tool under pressure of a nip roll, and the slurry was then irradiated with visible light from two visible lamps ("D" bulbs, commercially available from Fusion Corp.) operating at 600 Watts/inch. The nip pressure between the production tool and the backing was about 80 pounds (27 kg). Upon exposure to UV radiation, the binder precursor was converted into a binder and the abrasive slurry was converted into an abrasive composite. Then, the abrasive composites/backing, which formed the abrasive article, was wound onto a core. The process was a continuous process and operated at approximately 30 ft/min (9.1 meters/minute). The shaped abrasive composites/backing was wound up onto the core and as subsequently used for Examples 2-4 was then heated for 24 hours at 240° F. (115° C.) to fully cure, as needed, the shaped abrasive composites and the cloth backing treatments. The shaped abrasive composites/backing used for Example 1 was heated for approximately 12 hours in an oven set at 190° F. (88° C.) to complete the cure of the binder systems and to activate the primer on the polyester backing To prepare the abrasive articles for testing, the shaped abrasive composites/backing sheets were laminated to a 0.762 mm (0.030 inch) thick polycarbonate sheet reinforcing layer (Lexan™ 8010MC, available from GE Polymer Shapes, Mount Vernon, Ind.) for lamination. In Example 1, pressure sensitive adhesive tape was used ("442 KW", available from 3M, St. Paul, Minn.). In Examples 2-4, high-strength pressure-sensitive adhesive tape ("9473PC" available from 3M, St. Paul, Minn.) was used for lamination. Twelve inch (30.48 cm) diameter circular test discs were then die cut to form the abrasive articles (abrasive composite pad) for testing.

Method 3: Procedure for Single-Sided Grinding Test

Grinding tests were performed on a 6DC single-side lapping machine available from Strasbaugh (San Luis Obispo, Calif.). The abrasive composite pad was mounted to the machine platen using a pressure-sensitive adhesive.

The abrasive composite pads were initially prepared for testing by conditioning using alumina fixed abrasive (268XA A35, available from 3M Company, St Paul Minn.). The 5 inch (127 mm) diameter 268XA A35 discs were mounted to a 6 inch (152 mm) diameter×0.6 inch (15 mm) thick aluminum metal plate to form a conditioning plate. The conditioning plate was attached to the upper head of the lapping machine and was run at an applied pressure of 2 psi (13.8 kPa) for 4 minutes using a 100 rpm platen speed and counter-rotating 100 rpm conditioning plate speed. During conditioning, deionized water was supplied at a flow rate of 30 mL/min.

Transparent spinel ($MgAl_2O_4$) ceramic test pieces were obtained from Nutek Precision Optical Corporation, Aberdeen Md. Three 1.5 inch (38.1 mm) diameter×0.44 inch (11.1 mm) thick pieces were mounted to a 6 inch (152 mm) diameter×0.6 inch (15 mm) aluminum metal test sample plate using mounting resin (Crystalbond 509 Clear, Aremco Products, Inc, Valley Cottage N.Y.).

A series of grinding tests was performed using the 6DC single-side lapping machine with the abrasive composite pads mounted on the 12 inch (304 mm) diameter machine platen and rotated at 100 rpm. The sample plate with three mounted spinel test pieces was rotated at 100 rpm in a direction opposite to that of the abrasive composite pad, with applied pressure of 5 psi (34.5 kPa). A 10 vol % solution of Sabrelube 9016 (Chemetall Oakite, Lake Bluff Ill.) in deionized water was supplied to the abrasive composite pad surface at a flow rate of 30 mL/min. Multiple 5-minute test cycles were run for each abrasive composite pad, and the total weight loss for the three spinel samples recorded after each test cycle. The material removal rate for the spinel ceramic test samples was calculated by converting the total weight loss for three spinel samples (M in grams) to surface thickness removed (T in μm/minute) using the following equation:

$$T=9400\times M/(A\times D)$$

Where A=area of each test piece ($cm^2$) and D=density of each test piece ($g/cm^3$). The density of the spinel ceramic test pieces was assumed to be 3.58 $g/cm^3$.

Method 4: Measurement of Surface Finish

The surface finish (Ra) of spinel ceramic test pieces was measured after the first grinding test cycle, and at the end of every second grinding test cycle thereafter. Ra is the arithmetic average of the scratch depth expressed in microinches (μin). Ra was measured using a Mahr Perthometer profilometer (Model M4P, available from Mahr Corporation, Cincinnati, Ohio). Each of the three mounted spinel ceramic test pieces was measured twice, and the resulting surface finish for the grinding test cycle expressed as the average of the six measurements.

Example 1

Abrasive article Example 1 listed in Table 3 was prepared according to Method 2, and included 9 μm vitrified agglomerate abrasive particles prepared according to Method 1. Example 1 was used to grind spinel ceramic test samples according to Method 3 and resulting surface finishes were measured according to Method 4. Test results are summarized in Table 4. Example 1 comprised hexagonal shaped abrasive composites having an abrasive diamond content of 7.00 weight percent, 2.22 shaped abrasive composites per linear cm, 5.37 shaped abrasive composites per $cm^2$ and a bearing area ratio of 58.0 percent.

Examples 2-4

Abrasive article Examples 2-4 listed in Table 3 were prepared according to Method 2. Examples 2-4 were used to grind spinel ceramic test samples according to Method 3 and resulting surface finishes were measured according to Method 4. Test results are summarized in Table 4.

Example 2 comprised hexagonal shaped abrasive composites having an abrasive diamond content of 27.60 weight percent, 2.33 shaped abrasive composites per linear cm, 6.12 shaped abrasive composites per $cm^2$, and a bearing area ratio of 64.0 percent.

Example 3 comprised hexagonal shaped abrasive composites having an abrasive diamond content of 26.20 weight percent, 2.33 shaped abrasive composites per linear cm, 6.12 shaped abrasive composites per $cm^2$, and a bearing area ratio of 64.0 percent.

Example 4 comprised hexagonal shaped abrasive composites having an abrasive diamond content of 25.70 weight percent, 2.33 shaped abrasive composites per linear cm, 6.12 shaped abrasive composites per $cm^2$, and a bearing area ratio of 64.0 percent.

Comparative Example A

Comparative Example A was a structured, film-backed fixed abrasive composite pad, grade 9 micron, commercially available from 3M Company, St Paul Minn. under the trade designation "677XA". Comparative Example A was used to grind spinel ceramic test samples according to Method 3 and resulting surface finishes were measured according to Method 4. Test results are summarized in Table 4. Comparative Example A comprised square shaped abrasive composites having an abrasive diamond content of 2.28 weight percent by weight, 2.63 shaped abrasive composites per linear cm, 6.35 shaped abrasive composites per $cm^2$, and a bearing area ratio of 44.4 percent.

TABLE 4

| Example No. | Test Cycle | Cumulative Time (min) | Total wt loss M (g) | Removal rate T (μm/min) | Surface finish Ra (μin) |
|---|---|---|---|---|---|
| Example 1 | 1 | 5 | 4.67 | 76.3 | 10.59 |
| | 2 | 10 | 4.74 | 77.5 | |
| | 3 | 15 | 4.74 | 77.5 | 9.86 |
| | 4 | 20 | 4.68 | 76.5 | |
| | 5 | 25 | 4.82 | 78.8 | 10.22 |
| | 6 | 30 | 4.94 | 80.7 | |
| | 7 | 35 | 4.97 | 81.2 | 10.36 |
| Comparative Example A | 1 | 5 | 1.79 | 29.2 | 10.22 |
| | 2 | 10 | 1.62 | 26.5 | |
| | 3 | 15 | 1.49 | 24.3 | 10.16 |
| | 4 | 20 | 1.72 | 28.1 | |
| | 5 | 25 | 1.72 | 28.1 | 10.06 |
| | 6 | 30 | 1.86 | 30.4 | |
| | 7 | 35 | 1.98 | 32.4 | 10.12 |
| Example 2 | 1 | 5 | 11.04 | 170.6 | 33.85 |
| | 2 | 10 | 10.28 | 158.9 | |
| | 3 | 15 | 9.35 | 144.5 | 30.48 |
| | 4 | 20 | 8.67 | 134.0 | |
| | 5 | 25 | 7.98 | 123.3 | 27.73 |
| | 6 | 30 | 7.51 | 116.1 | |
| | 7 | 35 | 6.84 | 105.7 | 26.98 |
| Example 3 | 1 | 5 | 15.11 | 246.5 | 52.23 |
| | 2 | 10 | 15.76 | 257.1 | |
| | 3 | 15 | 14.67 | 239.3 | 44.30 |
| | 4 | 20 | 13.43 | 219.1 | |
| | 5 | 25 | 12.78 | 208.5 | 42.45 |
| | 6 | 30 | 12.00 | 195.8 | |
| | 7 | 35 | 11.28 | 184.0 | 39.42 |
| Example 4 | 1 | 5 | 16.55 | 255.8 | 63.13 |
| | 2 | 10 | 20.42 | 315.6 | |
| | 3 | 15 | 19.30 | 298.3 | 71.13 |
| | 4 | 20 | 18.54 | 286.5 | |
| | 5 | 25 | 17.36 | 268.3 | |
| | 6 | 30 | 15.79 | 244.0 | 58.00 |

Examples 1-4 produced significantly higher stock removal rates than Comparative Example A while still producing acceptable surface finish values. Furthermore, Examples 1-4 have higher stock removal rates and are significantly faster than using an abrasive slurry during the pre-polish grind and finish step on a flat lapping machine while processing ceramic transparent armor to produce an optically clear surface.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety. In the event of inconsistencies or contradictions between the incorporated references and this application, the information in the preceding description shall control. The preceding description, in order to enable one of ordinary skill in the art to practice the claimed invention, is not to be construed as limiting the scope of the invention, which is defined by the claims and all equivalents thereto.

What is claimed is:

1. A method of finishing transparent ceramic armor selected form the group consisting of spinel, sapphire, and aluminum oxynitride, the method comprising the steps of:

rough grinding a first surface of the transparent armor;

intermediate pre-polish grinding the first surface after rough grinding with a first structured abrasive article comprising:

a structured abrasive layer adhered to a first side of a backing, the structured abrasive layer having a plurality of abrasive composites;

the plurality of abrasive composites comprising agglomerates and a matrix binder;

the agglomerates comprising a glass binder and diamond abrasive particles having an average size of 15 micrometers or less and the agglomerate size is about 40 to about 400 micrometers; and the structured abrasive layer having a bearing area ratio between about 40 percent to about 70 percent;

intermediate pre-polish grinding the first surface after pre-polish grinding the first surface with the first structured abrasive article with a second structured abrasive article comprising:

a structured abrasive layer adhered to a first side of a backing, the structured abrasive layer having a plurality of abrasive composites;

the plurality of abrasive composites comprising agglomerates and a matrix binder;

the agglomerates comprising a glass binder and diamond abrasive particles having an average size of 15 micrometers or less and the agglomerates size is about 40 to about 400 micrometers;

the structured abrasive layer having a bearing area ratio between about 40 percent to about 70 percent; and wherein the diamond abrasive particles of the second structured abrasive article have a particle size no more than 50% of the size of the diamond abrasive particles in the first structured abrasive article.

2. The method of claim 1 wherein the rough grinding step comprises using a Blanchard grinding machine.

3. The method of claim 1 wherein after pre-polish grinding the first surface with the second structured abrasive article, the first surface is final polished to optical clarity with an abrasive slurry.

4. The method of claim 1 wherein after pre-polish grinding the first surface with the second structured abrasive article, the first surface has an Ra between 0.0 and about 1 μin.

5. The method of claim 1 wherein a second side of the backing of both the first and the second structured abrasive articles is attached to a reinforcing layer with and adhesive layer.

6. The method of claim 1 wherein a removal rate, T, is 76.3 μm/min or greater when using the first structured abrasive article.

7. The method of claim 1 wherein the diamond abrasive particles comprise about 4 weight percent to about 30 weight percent of the structured abrasive layer of the first structured abrasive article.

* * * * *